US006974057B1

(12) United States Patent
Smith

(10) Patent No.: US 6,974,057 B1
(45) Date of Patent: Dec. 13, 2005

(54) NECKTIE AND BELT HOLDING ASSEMBLY

(76) Inventor: Steven D. Smith, 1070 Calvary Church Rd., Sanford, NC (US) 27332

( * ) Notice: Subject to any disclaimer, the term of this patent is extended or adjusted under 35 U.S.C. 154(b) by 181 days.

(21) Appl. No.: 10/699,016

(22) Filed: Nov. 3, 2003

(51) Int. Cl.[7] ..... A41D 27/22
(52) U.S. Cl. ..... 223/85
(58) Field of Search ..... 223/85, 87, 88, 223/89, 90, 91, 92, 93, 94, 95, 96, 97; 211/85.2, 211/85.3, 95, 113, 115, 119; 248/304, 340

(56) References Cited

U.S. PATENT DOCUMENTS

| | | | | |
|---|---|---|---|---|
| 1,617,116 A | | 2/1927 | Hoy | |
| 3,584,746 A | * | 6/1971 | Marchman | 211/116 |
| 3,935,976 A | * | 2/1976 | Mizrach | 223/88 |
| 4,261,490 A | | 4/1981 | Schwartzstein | |
| 4,438,874 A | * | 3/1984 | Zuckerman et al. | 223/88 |
| D281,552 S | | 12/1985 | Zuckerman et al. | |
| 5,297,706 A | | 3/1994 | Blitz | |
| 5,642,841 A | | 7/1997 | Beaty | |
| 5,664,708 A | * | 9/1997 | Sacks | 223/85 |
| 5,934,524 A | | 8/1999 | Gray | |
| 6,202,905 B1 | * | 3/2001 | Heide | 223/94 |
| 6,398,086 B1 | * | 6/2002 | Bennett | 223/87 |

* cited by examiner

*Primary Examiner*—Gary L. Welch

(57) ABSTRACT

A necktie and belt holding assembly includes a pair of hangers each comprising a loop that includes a bottom member, a first side member, a second side member and a top member. Each of a pair of master hooks is attached to one of the top members. A hinge is attached to the each of the first side members such that the pair of hangers is hingedly coupled together. The pair of hangers may be selectively spaced from each other in an open position or positioned adjacent to each other in a closed position. An inner surface and an outer surface of each of the bottom members and the second side members are defined with respect to each other. Each of a plurality of clips is attached one of the bottom members. The clips are each attached to a respective one of the outer surfaces of the bottom members.

18 Claims, 3 Drawing Sheets

NECKTIE AND BELT HOLDING ASSEMBLY

BACKGROUND OF THE INVENTION

1. Field of the Invention

The present invention relates to belt and necktie holding devices and more particularly pertains to a new belt and necktie holding device for holding a plurality of neckties and belts in an organized manner which will preserve the shape of the neckties and belts.

2. Description of the Prior Art

The use of belt and necktie holding devices is known in the prior art. While these devices fulfill their respective, particular objectives and requirements, the need remains for a device that holds a plurality of neckties and belts by way of a relatively small apparatus such that the apparatus may easily be positioned within a closet or removed from the closet and fit into a garment bag. This should also be accomplished without concern that the neckties or belt will come loose from their secured position.

SUMMARY OF THE INVENTION

The present invention meets the needs presented above by utilizing a pair of hangers that may be easily positioned in a closet or easily within a garment bag.

Another object of the present invention is to provide a new belt and necktie holding device that includes a plurality of clips attached to the hangers that will securely hold a necktie to the hangers without fear that the neckties will come loose from the hanger, particularly when the hangers are transferred from a closet to a garment bag.

Still another object of the present invention is to provide a new belt and necktie holding device that provides both buckle hooks and belt aperture hooks for selectively securing, in two places, a belt to the hangers to ensure that they are retained thereon.

To this end, the present invention generally comprises a pair of hangers. Each of the hangers comprises a substantially rigid loop that includes a bottom member, a first side member, a second side member and a top member. Each of a pair of master hooks is attached to one of the top members and extends upwardly away therefrom. A hinge is attached to the each of the first side members such that the pair of hangers are hingedly coupled together. The pair of hangers may be selectively spaced from each other in an open position or positioned adjacent to each other in a closed position such that the second side members and the bottom members are positioned generally adjacent to and aligned with each other. An inner surface and an outer surface of each of the bottom members and the second side members are defined with respect to each other. Each of a plurality of clips is attached one of the bottom members such that each of the hangers has at least two clips attached thereto. The clips are each attached to a respective one of the outer surfaces of the bottom members.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
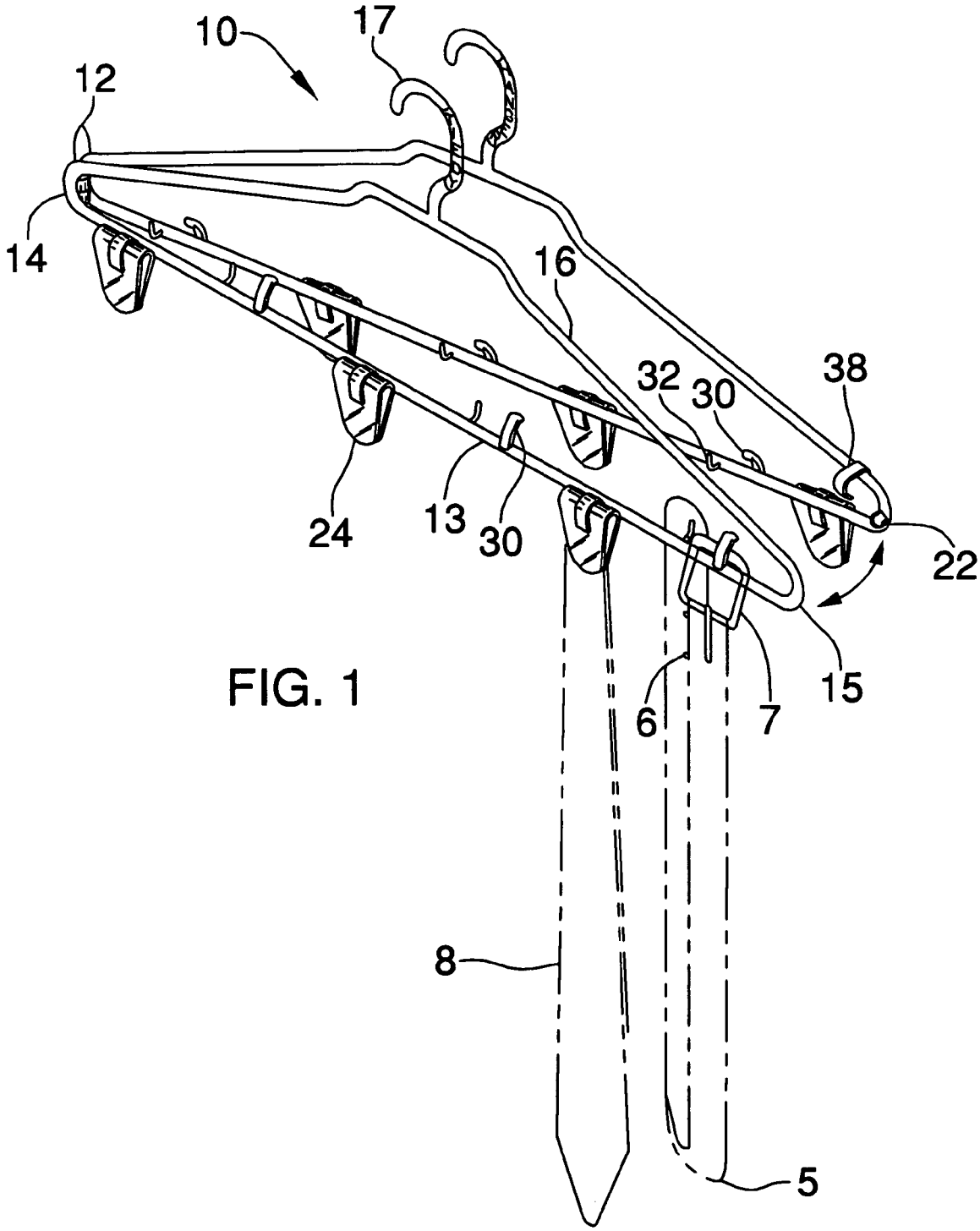
FIG. 1 is a schematic perspective view of a necktie and belt holding assembly according to the present invention.
Figure 2:
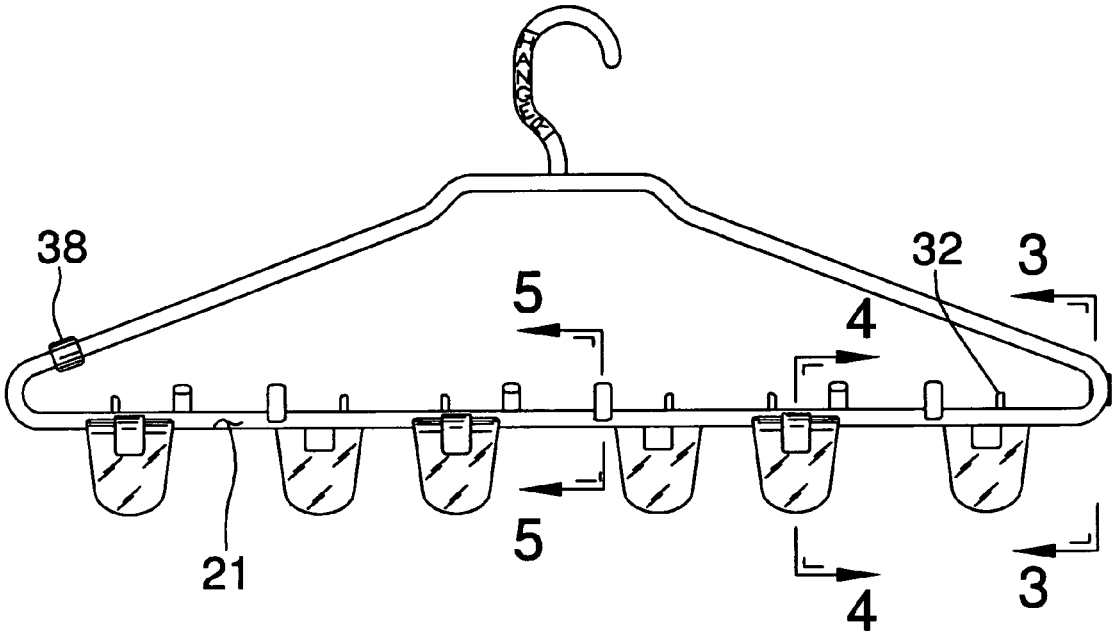
FIG. 2 is a schematic front view of the present invention.
Figure 3:
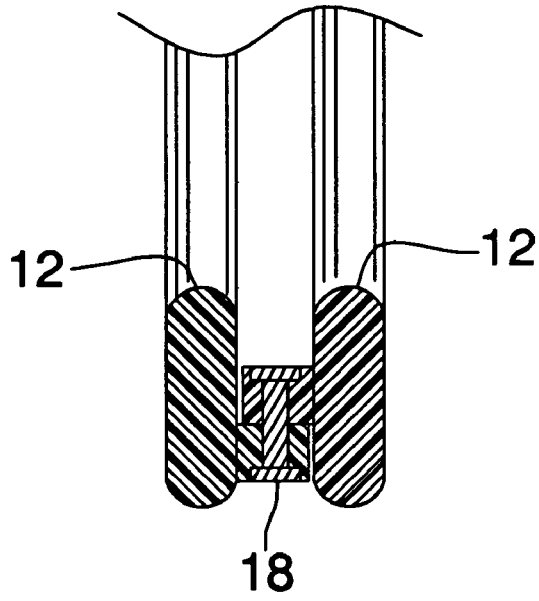
FIG. 3 is a schematic cross-sectional view taken along line 3—3 of FIG. 2 of the present invention.
Figure 4:
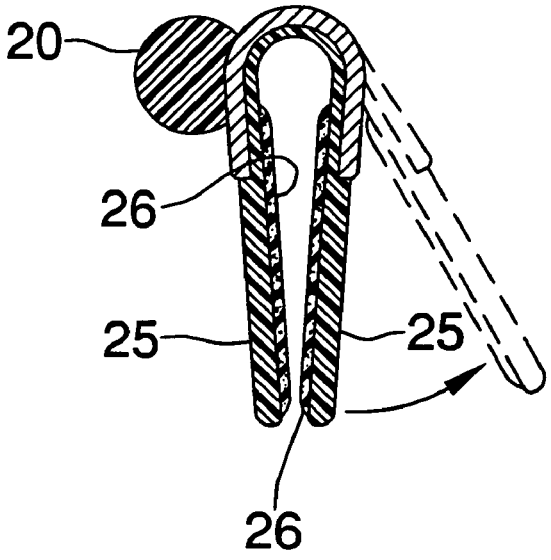
FIG. 4 is a schematic cross-sectional view taken along line 4—4 of FIG. 2 of the present invention.
Figure 5:
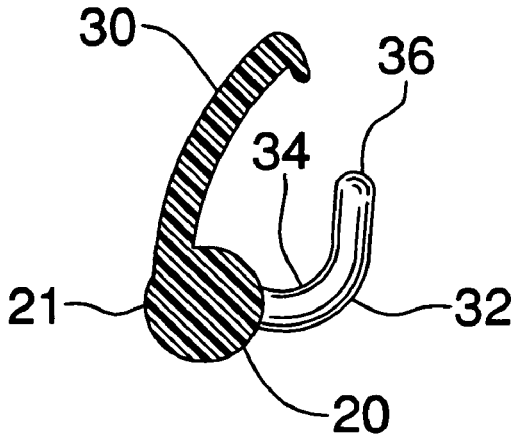
FIG. 5 is a schematic cross-sectional view taken along line 5—5 of FIG. 2 of the present invention.

With reference now to the drawings, and in particular to FIGS. 1 through 5 thereof, a new belt and necktie holding device embodying the principles and concepts of the present invention and generally designated by the reference numeral 10 will be described.

As best illustrated in FIGS. 1 through 5, the necktie and belt holding assembly 10 generally comprises a pair of hangers 12. Each of the hangers 12 comprises a substantially rigid loop including a bottom member 13, a first side member 14, a second side member 15 and a top member 16. Each of a pair of master hooks 17 is attached to one of the top members 16 and extends upwardly away therefrom. The hangers 12 generally have a conventional shape for a hanger.

A hinge 18 is attached to the each of the first side members 14 such that the pair of hangers 12 is hingedly coupled together. The pair of hangers 12 may be selectively spaced from each other in an open position or positioned adjacent to each other in a closed position such that the second side members 15 and the bottom members 13 are positioned generally adjacent to and aligned with each other. An inner surface 20 and an outer surface 21 of each of the bottom members 13 and the second side members 15 are defined with respect to each other. The hinge 18 is attached to the inner surfaces 20 of the first side members 14. A spacer 22 is attached to an inner surface 20 of one of the second side members 15 such that the spacer 22 abuts the other of the second side members 15 and retains the second side members 15 in a spaced relationship with each other when the pair of hangers 12 is in the closed position. Preferably, the spaced relationship is generally between ¼ inch and ¾ inch.

Each of a plurality of clips 24 is attached to each of the bottom members 13 such that each of the hangers 12 has at least two clips 24 attached thereto and the clips are positioned in a spaced relationship from each other. The clips 24 are each attached to a respective one of the outer surfaces 21 of the bottom members 13. The clips 24 each have a pair of arms 25 biased toward each other. Each of the arms 25 has an interior surface and a cushioning material 26 is attached to and substantially covers each of the interior surfaces. A positioning of the clips 24 on the bottom members 24 is staggered with respect to each other when the pair of hangers 12 is in the closed position.

Each of a plurality of buckle hooks 30 is attached to each of the bottom members 13 such that each of the hangers 12 has at least two buckle hooks 30 attached thereto. The buckle hooks 30 on each of the bottom members 14 are spaced from each other and the clips 24. Each of the buckle hooks 30 comprises a rod extending upwardly from a respective one of the bottom members 13 that is angled toward the other of the bottom members 13. The buckle hooks 30 each have a diameter greater than 3/16 inch. A positioning of the buckle hooks 30 on the bottom members 13 is staggered with respect to each other when the pair of hangers 12 is in the closed position.

A plurality of belt aperture hooks 32 is attached to each of the bottom members 13 such that each of the hangers 12 has at least two belt aperture hooks 32 attached thereto. Each of the belt aperture hooks 32 on each of the bottom members 13 is spaced from each other. The belt aperture hooks 32 each comprise a foot member 34 extending outwardly away from an inner surface 20 of a respective one of the bottom members 13 and a leg member 36 extending upwardly away from an end of the foot member 34. The foot members 34 each have a length less than 1/4 inch. Each of the belt aperture hooks 32 has a diameter less than 1/8 inch such that they may be extending through the apertures 6 of a conventional belt 5. A positioning of the belt aperture hooks 32 on the bottom members 13 is staggered with respect to each other when the pair of hangers 12 is in the closed position. Ideally, each of the belt aperture hooks 32 is positioned adjacent to one of the buckle hooks 30 such that a belt buckle 7 of the belt 5 may be positioned over one of the buckle hooks 30 and the belt 5 attached to one of the belt aperture hooks 32. In this position, the buckle 7 would be positioned adjacent to an outer surface 21 of the corresponding bottom member 13 while the belt 5 would be positioned between the pair of hangers 12.

Ideally, a securing member 38 is attached to one of the pair of hangers 12 for selectively securing the pair of hangers 12 in the closed position. The securing member 38 is preferably a securing hook that is attached to one of the top members 16 and may be hooked onto the other of the top members 16 when the pair of hangers 12 is in the closed position.

Preferably, each of the hangers 12, and the attached clips 24, buckle hooks 30 and belt aperture hooks 32 are identical with each other except that that the master hooks 17 are turned opposite with respect to each other. Thus, when the master hooks 17 are aligned, the clips 24, buckle hooks 30 and belt aperture hooks 32 are staggered with respect to each other. Ideally, there are three clips 24 attached to each the hangers 12 and three buckle hooks 30 attached to the hangers 12. The clips 24 and buckle hooks 30 are alternately positioned on the bottom members.

In use, neckties 8 are selectively attached to the bottom members 13 with the clips 24. The cushioning material 26 prevents damage to the neckties 8 from being snagged or torn by the clips. Belts 5 may be positioned on the assembly 10 as described above. The hangers 12, with belts 5 and ties 8 attached thereto, may then be hung on a conventional rod found within a closet. Because the clips 24 and buckle hooks 30 are staggered, it is possible to position multiple belts 5 and neckties 8 on the assembly 10 while retaining an organized layout of their storage. It is also preferred that the master hooks 17 are labeled and colored to ensure that they are easily identifiable within a closet.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An apparatus for holding a plurality of ties and belts, said apparatus including:

a pair of hangers, each of said hangers comprising a substantially rigid loop including a bottom member, a first side member, a second side member and a top member, each of a pair of master hooks being attached to one of said top members and extending upwardly away therefrom;

a hinge being attached to said each of said first side members such that said pair of hangers are hingedly coupled together, wherein said pair of hangers may be selectively spaced from each other in an open position or positioned adjacent to each other in a closed position such that said second side members and said bottom members are positioned generally adjacent to and aligned with each other, an inner surface and an outer surface of each of said bottom members and said second side members being defined with respect to each other; and a plurality of clips being attached to each of said bottom members such that each of said hangers has at least two clips attached thereto, each of said clips being attached to a respective one of said outer surfaces of said bottom members.

2. The apparatus of claim 1, wherein each of said clips includes a pair of arms biased toward each other, each of said arms having an interior surface, a cushioning material being attached to and substantially covering each of said interior surfaces.

3. The apparatus of claim 1, further including a plurality of buckle hooks being attached to each of said bottom members such that each of said hangers has at least two buckle hooks attached thereto.

4. The apparatus of claim 3, wherein each of said buckle hooks comprises a rod extending upwardly from a respective one of said bottom members and is angled toward the other of said bottom members.

5. The apparatus of claim 4, wherein each of said buckle hooks has a diameter greater than 3/16 inch.

6. The apparatus of claim 4, further including:

a spacer being attached to an inner surface of one of said second side members such that said spacer abuts the other of said second side members and retains said second side members in a spaced relationship with each other when said pair of hangers are in said closed position;

a plurality of belt aperture hooks being attached to each of said bottom members such that each of said hangers has at least two belt aperture hooks attached thereto, each of said belt aperture hooks on each of said bottom members being spaced from each other, each of said belt aperture hooks comprising a foot member extending outwardly away from an inner surface of a respective one of said bottom members and a leg member extending upwardly away from an end of said foot member.

7. The apparatus of claim 6, each of foot members having a length less than 1/4 inch, each of said belt aperture hooks having a diameter less than 1/8 inch.

8. The apparatus of claim 7, wherein a positioning of said belt aperture hooks on said bottom members is staggered with respect to each other when said pair of hangers are in said closed position.

9. The apparatus of claim 8, further including a securing member being attached to one of said pair of hangers for selectively securing said pair of hangers in said closed position.

10. The apparatus of claim 6, wherein each of said clips includes a pair of arms biased toward each other, each of said arms having an interior surface, a cushioning material being attached to and substantially covering each of said interior surfaces.

11. The apparatus of claim 3, wherein a positioning of said buckle hooks on said bottom members is staggered with respect to each other when said pair of hangers are in said closed position.

12. The apparatus of claim 3, further including a securing member being attached to one of said pair of hangers for selectively securing said pair of hangers in said closed position.

13. The apparatus of claim 3, wherein each of said clips includes a pair of arms biased toward each other, each of said arms having an interior surface, a cushioning material being attached to and substantially covering each of said interior surfaces.

14. The apparatus of claim 1, further including:

a spacer being attached to an inner surface of one of said second side members such that said spacer abuts the other of said second side members and retains said second side members in a spaced relationship with each other when said pair of hangers are in said closed position;

a plurality of belt aperture hooks being attached to each of said bottom members such that each of said hangers has at least two belt aperture hooks attached thereto, each of said belt aperture hooks on each of said bottom members being spaced from each other, each of said belt aperture hooks comprising a foot member extending outwardly away from an inner surface of a respective one of said bottom members and a leg member extending upwardly away from an end of said foot member.

15. The apparatus of claim 14, each of foot members having a length less than ¼ inch, each of said belt aperture hooks having a diameter less than ⅛ inch.

16. The apparatus of claim 15, wherein a positioning of said belt aperture hooks on said bottom members is staggered with respect to each other when said pair of hangers are in said closed position.

17. The apparatus of claim 16, further including a securing member being attached to one of said pair of hangers for selectively securing said pair of hangers in said closed position.

18. An apparatus for holding a plurality of ties and belts, said apparatus including:

a pair of hangers, each of said hangers comprising a substantially rigid loop including a bottom member, a first side member, a second side member and a top member, each of a pair of master hooks being attached to one of said top members and extending upwardly away therefrom;

a hinge being attached to said each of said first side members such that said pair of hangers are hingedly coupled together, wherein said pair of hangers may be selectively spaced from each other in an open position or positioned adjacent to each other in a closed position such that said second side members and said bottom members are positioned generally adjacent to and aligned with each other, an inner surface and an outer surface of each of said bottom members and said second side members being defined with respect to each other, said hinge being attached to said inner surfaces of said first side members, a spacer being attached to an inner surface of one of said second side members such that said spacer abuts the other of said second side members and retains said second side members in a spaced relationship with each other when said pair of hangers are in said closed position, said spaced relationship being generally between ¼ inch and ¾ inch;

a plurality of clips being attached to each of said bottom members such that each of said hangers has at least two clips attached thereto, each of said clips on each of said bottom members being spaced from each other, each of said clips being attached to a respective one of said outer surfaces of said bottom members, each of said clips having a pair of arms biased toward each other, each of said arms having an interior surface, a cushioning material being attached to and substantially covering each of said interior surfaces, a positioning of said clips on said bottom members being staggered with respect to each other when said pair of hangers are in said closed position;

a plurality of buckle hooks being attached to each of said bottom members such that each of said hangers has at least two buckle hooks attached thereto, each of said buckle hooks on each of said bottom members being spaced from each other and said clips, each of said buckle hooks comprising a rod extending upwardly from a respective one of said bottom members and being angled toward the other of said bottom members, each of said buckle hooks having a diameter greater than 3/16 inch, a positioning of said buckle hooks on said bottom members being staggered with respect to each other when said pair of hangers are in said closed position;

a plurality of belt aperture hooks being attached to each of said bottom members such that each of said hangers has at least two belt aperture hooks attached thereto, each of said belt aperture hooks on each of said bottom members being spaced from each other, each of said belt aperture hooks comprising a foot member extending outwardly away from an inner surface of a respective one of said bottom members and a leg member extending upwardly away from an end of said foot member, each of foot members having a length less than ¼ inch, each of said belt aperture hooks having a diameter less than ⅛ inch, a positioning of said belt aperture hooks on said bottom members being staggered with respect to each other when said pair of hangers are in said closed position; and a securing member being attached to one of said pair of hangers for selectively securing said pair of hangers in said closed position.

* * * * *